US006142190A

United States Patent [19]

Nakada et al.

[11] Patent Number: 6,142,190

[45] Date of Patent: Nov. 7, 2000

[54] PICKING METHOD AND APPARATUS FOR MULTICOLOR PICKING LOOM

[75] Inventors: Akihiko Nakada; Zenji Tamura, both of Ishikawa, Japan

[73] Assignee: Tsudakoma Kogyo Kabushiki Kaisha, Kanazawa, Japan

[21] Appl. No.: 09/401,316

[22] Filed: Sep. 23, 1999

[30] Foreign Application Priority Data

Sep. 24, 1998 [JP] Japan ..... 10-269905

[51] Int. Cl.[7] ..... D03D 51/12

[52] U.S. Cl. ..... 139/435.5; 139/435.2

[58] Field of Search ..... 139/435.5, 435.2, 139/435.1

[56] References Cited

U.S. PATENT DOCUMENTS

| | | | |
|---|---|---|---|
| 4,463,783 | 8/1984 | Suzuki et al. | 139/435.2 |
| 5,095,953 | 3/1992 | Makino | 139/435.2 |
| 5,115,840 | 5/1992 | Yamada | 139/435.2 |
| 5,293,907 | 3/1994 | Tamura . | |

FOREIGN PATENT DOCUMENTS

| | | |
|---|---|---|
| 0 534 318 | 3/1993 | European Pat. Off. . |
| 2 522 029 | 8/1963 | France . |
| 62-125047 | 6/1987 | Japan . |
| 5-78955 | 3/1993 | Japan . |
| 63-149979 | 10/1998 | Japan . |

*Primary Examiner*—Andy Falik
*Attorney, Agent, or Firm*—Finnegan, Henderson, Farabow, Garrett & Dunner, L.L.P.

[57] ABSTRACT

A picking method and apparatus for a multicolor picking loom to provide changes in the number of rotations of the loom in order to pick a desired weft. In particular, a signal generation unit outputs a weft selection signal for each weft corresponding to a picking number, and a number-of-rotations selection signal also corresponding to a picking number. A plurality of number-of-rotations patterns are preset and each pattern corresponds to one of the number-of-rotations selection signals. In addition, a plurality of picking conditions are preset which correspond to the particular weft selection signal for the selected weft and to one of the number-of-rotations patterns. Of the plurality of picking conditions, the picking condition is selected which corresponds to the weft selection signal and the number-of-rotations selection signal, which allows the desired and selected weft to be picked.

8 Claims, 8 Drawing Sheets

PICKING NUMBER
0° SIGNAL TM0
WEFT SELECTION SIGNAL
CL1
CL3
WEFT SELECTION
NUMBER-OF-ROTATIONS
SELECTION SIGNAL RT1
RT3
RD2
RU2
NUMBER-OF-ROTATIONS
SELECTION PATTERN
ACTUAL NUMBER-
OF-ROTATIONS VH
VM
VL
SELECTED PICKING
CONDITION
TIME t
i
k
n
1
2
i - 1
i
i + 1
i + 2
i + k
i + k + 1
i+k+2
ON
OFF
a
c
PH1
PU2
PL2
PD2
JaH1
JaU2
JcL2
JaD2
t1
t2
t3
t4

PICKING NUMBER
0° SIGNAL TM0
WEFT SELECTION SIGNAL
CL1
CL2
WEFT SELECTION
NUMBER-OF-ROTATIONS
SELECTION SIGNAL RT1
RT2
RD3
RU3
NUMBER-OF-ROTATIONS
SELECTION PATTERN
ACTUAL NUMBER-
OF-ROTATIONS VH
VM
VL
SELECTED PICKING
CONDITION
TIME t
i
k
n
1
2
i - 1
i
i + 1
i + 2
i + k
i + k + 1
i+k+2
ON
OFF
a
b
PH1
PU3
PL1
PD3
JaH1
JaU3
JbL1
JaD3
t2
t4

PICKING METHOD AND APPARATUS FOR MULTICOLOR PICKING LOOM

BACKGROUND OF THE INVENTION

1. Field of the Invention

The present invention relates to a technique for effecting more reliable picking of a weft during a transition phase in which the number of rotations of a loom is changed, in a multicolor picking loom which changes the number of rotations according to a weft which is selected and picked.

2. Description of the Related Art

In a case where a weft that travels easily and another weft that travels with difficulty are picked in a multicolor picking loom, the loom is usually operated at the number of rotations suitable for the traveling characteristics of the respective wefts in order to improve the productivity of a woven fabric. A weft that travels easily (hereinafter simply referred to as an "easy-to-travel weft") is picked at a large number of rotations. In contrast, a weft that travels with difficulty (hereinafter simply referred to as a "difficult-to-travel weft") requires a traveling time longer than that required by the easy-to-travel weft. Consequently, the difficult-to-travel weft is woven at a number of rotations lower than that at which the easy-to-travel weft is woven. Such an operation is achieved by the technique described in, e.g., Japanese Patent Unexamined Publication No. Hei-5-78955. According to this technique, the maximum allowable number of rotations of a loom, which is determined for each type of weft, is stored in the loom for each picking number, which represents a sequence in which a weft is picked during one picking cycle (a repetition of picking). The maximum allowable number of rotations corresponding to the picking number is output every rotation of the loom by driving a loom motor.

Techniques described in, e.g., Japanese Patent Unexamined Publication No. Sho-62-125047 and Japanese Utility Model Unexamined Publication No. Sho-63-149979, are intended to effect stable picking operations in tandem with changing of the number of rotations of the loom. A picking controller is provided, in advance, with picking conditions; namely, a plurality of picking settings for injection timing and pressure of nozzles. During the operation of the loom, picking conditions corresponding to a signal representing the number of rotations (hereinafter simply as a "number-of-rotations signal") detected are selected from the preset picking conditions, and a weft is picked according to the thus-selected picking conditions.

The above techniques are effected under certain conditions. However, in the event of quick changes in the number of rotations of the loom during a picking phase, optimum picking conditions corresponding to the picking phase are not set, thus causing a picking failure and halting the loom. Given that picking conditions corresponding to a change in the number of rotations of the loom are determined by detection of the number-of-rotations signal, the number of rotations will vary greatly even after setting of the picking conditions. A great discrepancy arises between the number of rotations of the loom at which a weft is actually picked and the number of rotations of the loom achieved when the picking conditions are determined. In practice, the weft cannot be picked under optimum picking conditions. To realize picking of the weft under optimum picking conditions even during the course of changes in the number of rotations of the loom, the change in the number of rotations must be constrained within the extent to which no picking failures arise. Eventually, the number of rotations of the loom can be changed only gradually, with the result that the productivity of a woven fabric is not improved.

SUMMARY OF THE INVENTION

The present invention has been conceived in view of the foregoing problems, and the object of the present invention is to ensure picking of a selected weft even in a multicolor picking loom which drastically changes the number of rotations of the loom according to a selected weft.

In order to achieve the object, according to a first aspect of the present invention, there is provided a picking method for use with a multicolor picking loom which changes the number of rotations according to selected wefts, the method including the steps of: previously setting picking conditions corresponding to the selected weft and a change pattern in the number of rotations in a pickable phase, during the course of changing the number of rotations; and selecting corresponding picking conditions from the preset picking conditions at the time of picking of a weft during the course of changing the number of rotations, thereby picking the selected weft.

Further, according to a second aspect of the present invention, there is provided a picking apparatus for use with a multicolor picking loom including: a selected signal generation unit which counts a picking number every rotation of the loom and outputs a weft selection signal and a number-of-rotations selection signal, both corresponding to the picking number; a drive unit which selects one from the plurality of preset patterns relating to the number of rotations previously set so as to correspond to the entry of the number-of-rotations selection signal and which drives the loom according to the thus-selected pattern; and a picking control unit picking a weft corresponding to the weft selection signal, the picking control unit including: a picking conditions setting device setting picking conditions which correspond to the selected weft and the change pattern in the number of rotations of the loom during the course of changing of the number of rotations, said picking conditions being stored so as to correspond to the weft selection signal and the number-of-rotations selection signal, and a main control unit selecting the corresponding picking conditions according to the number-of-rotations selection signal and the weft selection signal, both of which are received from the selection signal generating unit, whereby the selected weft is picked under the thus-selected picking conditions.

Here, the pickable phase signifies a period which is determined by a crank angle of a spindle and which physically enables picking of a weft into a warp shed with the assistance of nozzle injection. According to the present invention, at the time of picking operations during the course of changing the number of rotations, picking conditions are set so as to correspond to the change pattern in the number of rotations and to the selected weft.

The picking conditions, which are preset so as to correspond to the selected weft and the change pattern in the number of rotations during the pickable phase, include at least one of the timing at which picking nozzles squirt fluid, a fluid injection pressure, and the timing at which a measuring device releases a weft. Preferably, the picking conditions to be set in the picking conditions setting device may be those derived from past experience. Alternatively, the picking control unit receives a weft detection signal from a weft feeler which is disposed along the weft traveling path and detects the weft. From the thus-received weft detection signal, the weft control means determines a weft arrival time which corresponds to the selected picking conditions. Subsequent picking conditions to be selected may be corrected on the basis of a deviation from preset target values.

According to the first aspect of the present invention, a weft can be picked during the course of changing the number of rotations of the loom under picking conditions which are previously set so as to correspond to the selected weft and to the change pattern in the actual number of rotations in a pickable phase during the course of changing the number of rotations. Specifically, even if the number of rotations of the loom is changed abruptly, optimum picking conditions can be set in consideration of the change pattern in the number of rotations during the pickable phase, without involvement of so-called follow-up control for setting conditions. Therefore, the selected weft can be reliably picked, thereby preventing a picking failure which would otherwise be caused by the conventional technique and greatly improving the productivity of a woven cloth.

Further, the picking conditions set by the picking conditions setting device include at least one of the fluid injection timing of the picking nozzles, the fluid injection pressure, and the timing at which the measuring device releases the weft. If picking conditions obtained through past experience are used as the picking conditions, picking conditions can be quickly determined in response to the change in the type of textile. More preferably, the picking control means may receive a weft detection signal from a weft feeler which is disposed along the weft traveling path and detects the weft. From the thus-received weft detection signal, the weft control means may determine a weft arrival time which corresponds to the selected picking conditions. Subsequent picking conditions to be selected may be corrected on the basis of a deviation from preset target values. As a result, picking conditions to be selected can be made closer to optimum values in conjunction with progress in the weaving operation.

DETAILED DESCRIPTION OF THE PREFERRED EMBODIMENTS

Figure 1:
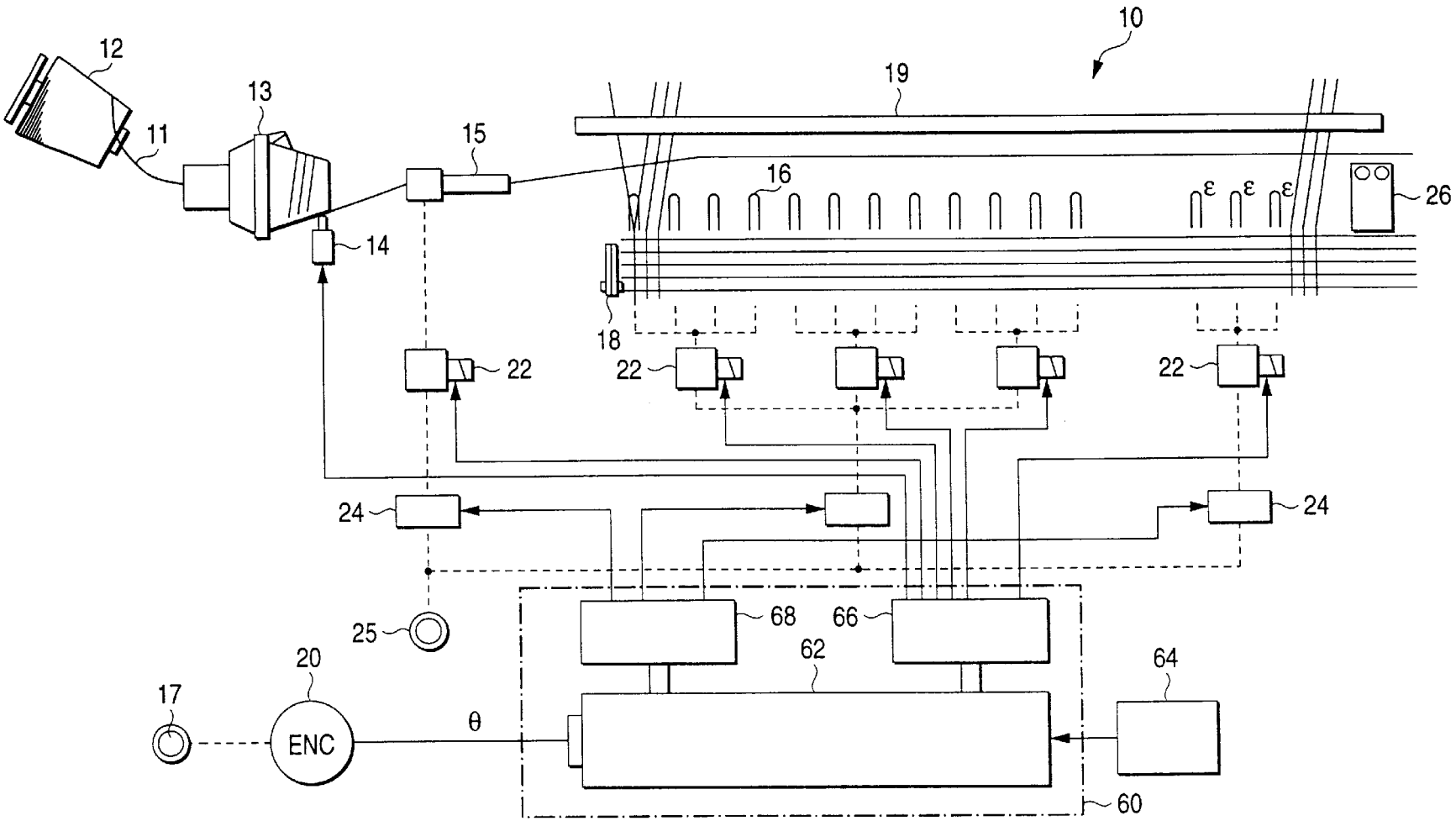
FIG. 1 is a schematic diagram showing a picking apparatus used in an air-jet loom.

A preferred embodiment of the present invention will be described hereinbelow by reference to the accompanying drawings. FIG. 1 shows a picking apparatus for an air-jet loom, which changes the number of rotations of a loom in response to a changeover in wefts. A loom 10 includes a yarn feeding member 12 for feeding a weft 11, a measuring drum 13, a lock pin 14 provided in the measuring drum 13, a main nozzle 15 for picking the weft 11 by means of an air blast, and a plurality of sub-nozzles 16 which are disposed along the travel path of the weft (hereinafter called "weft travel path") and assist the travel of the weft 11 by means of air blasts.

The main nozzle 15 is connected to a pressure regulator 24 composing of, for example, an electropneumatic proportional valve, by way of an electromagnetic valve 22 and an unillustrated air tank. The sub-nozzles 16 disposed along the weft travel path are classified into several groups in the direction of picking. The respective sub-nozzle groups are connected to the corresponding pressure regulators 24 by way of the electromagnetic valves 22 and the unillustrated air tanks. The pressure regulators 24, 24, . . . , 24 are connected to a shared fluid supplier 25. A spindle 17 of the loom 10 is connected with individual devices such as an unillustrated warp shedding device, a reed 19, and a yarn cutter 18, as well as to a motor 48 and a brake 50, as will be described later.

In the measuring drum 13, a predetermined number of turns of the weft 11 is wound around a fixing drum (not shown) by turning a yarn guide (not shown) around the fixing drum in correspondence with the rotation of the loom. The weft 11 is retained by the lock pin 14 disposed in its advancing position. At the time of shedding of warps, the lock pin 14 recedes to thereby render the weft 11 releasable. Picking nozzles; that is, the main nozzle 15 and the sub-nozzles 16, . . . , 16, squirt air in a relaying manner to thereby pick the weft 11. When the weft 11 is released in a predetermined number of turns in the measuring drum 13, the lock pin 14 advances to the advancing position, thereby retaining the weft 11. Picking of the weft 11 is completed, as shown in FIG. 1. The thus-picked weft 11 is beaten by the reed 19 and is cut by the yarn cutter 18. In this way, the weft 11 is woven sequentially.

Incidentally, in a multicolor picking loom which selects and picks a weft according to a preset picking pattern every rotation of the loom, the measuring members, such as the measuring drum 13 and the lock pin 14; the main nozzle 15; and the electromagnetic valve 22 and the pressure regulator 24 for controlling the blast of the main nozzle 15 are originally provided for each weft. For the sake of convenience, these embers are partially omitted from the drawings. Further, a weft feeler 26 is disposed in the weft travel path so as to oppose the reed 19 and outputs a signal upon detection of the weft 11.

Figure 2:
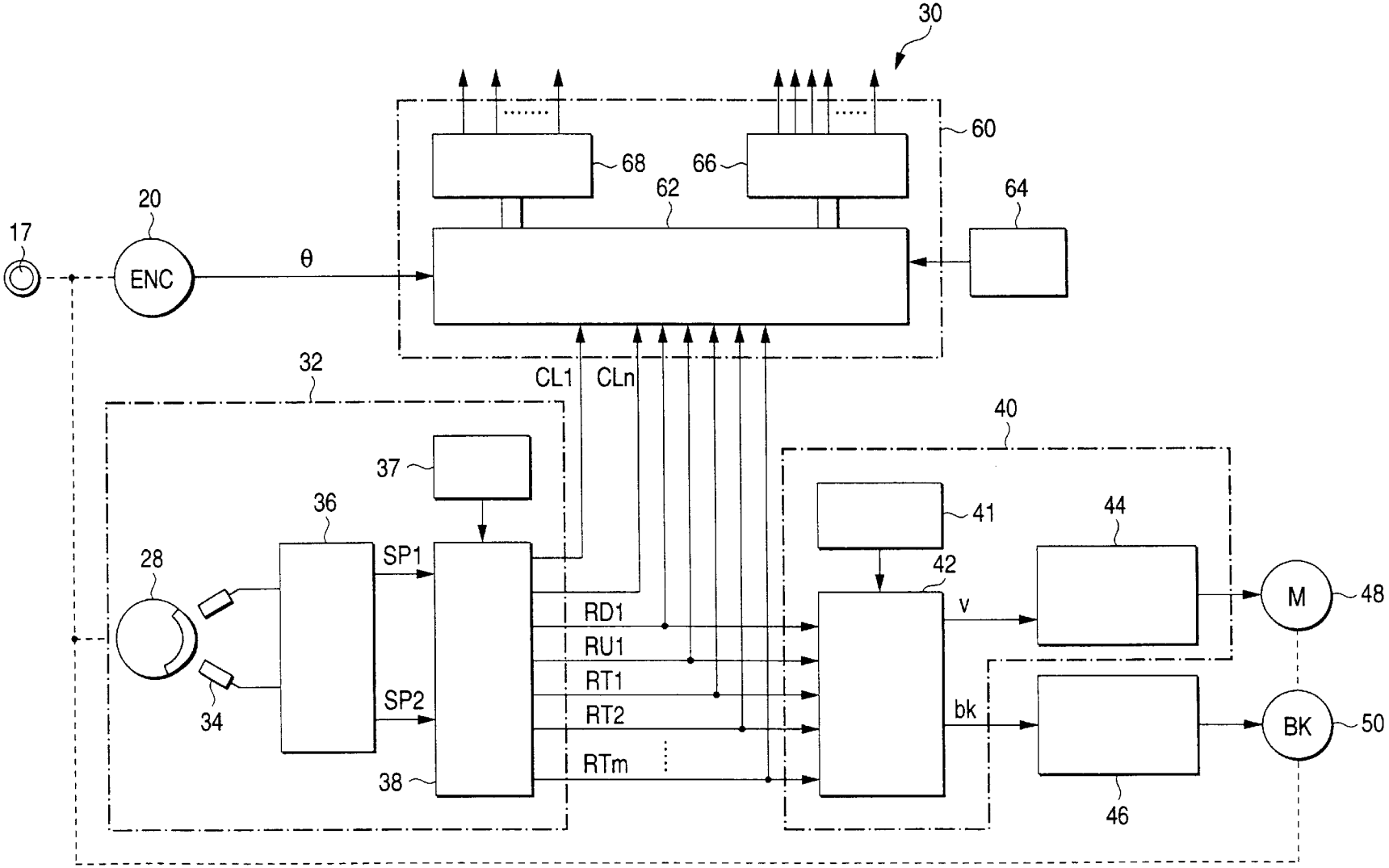
FIG. 2 is a control block diagram of the picking apparatus according to the present invention.

FIG. 2 is a control block diagram showing the picking apparatus according to the present invention. A loom controller 30 for controlling the loom includes a selection signal generation unit 32, a drive unit 40 which drives the loom by way of a motor, and a picking control unit 60 which controlls the measuring members and the picking nozzles according to the rotation of the loom. An encoder 20 which detects the crank angle of the loom is joined to the spindle 17, generates a crank angle signal θ relating to the loom, and supplies the thus-generated crank angle signal θ to the picking control unit 60.

The selection signal generation unit 32 includes a dog 28, proximity sensors 34, a stepping signal generator 36, a selection instruction setting device 37, and a selection signal generator 38. The two proximity sensors 34, 34 are disposed so as to oppose to the rotational peripheral surface of the dog 28 joined to the spindle 17 and sends to the stepping signal generator 36 detection signals of the dog 28. Since the two proximity sensors 34, 34 are spaced away from each other, two detection signals which have a phase difference with each other are delivered to the stepping signal generator 36. From these detection signals, the stepping signal generator 36 determines the direction of rotation of the spindle 17. Every rotation of the dog 28, the stepping signal generator 36 sends to the selection signal generator 38 a step forward signal SP1 when the dog 28 rotates forward, or a step backward signal SP2 when the dog 28 rotates backward.

The selection instruction setting device 37 can set a selection instruction according to each picking number—which represents the sequence in which the weft is picked during one picking cycle—and send the thus-set selection instructions to the selection signal generator 38. On the basis of the two step signals SP1 and SP2, the selection signal generator 38 counts the picking number in both ascending and descending sequence and outputs various selection signals on the basis of the selection instruction corresponding to the counted picking number. When the spindle rotates forward, the picking number which the selection signal generator 38 counts is incremented by one, by means of the step forward signal SP1 which is input every rotation of the spindle 17. When the picking number exceeds the number of picks constituting one picking cycle, the picking number is reset to 1. In contrast, when the spindle 17 rotates backward, the picking number is decreased by one, by means of the step backward signal SP2 which is input every rotation of the spindle 17. When achieving 0, the picking number is reset to the number of picks constituting ne picking cycle.

In the present embodiment, the selection signal generator 38 outputs weft selection signals CL1, . . . , CLn to the picking control unit 60 so as to correspond to the respective counted picking numbers. Further, the selection signal generator 38 outputs number-of-rotations selection signals RD1, RU1, RT1, . . . , RTm to the drive unit 40 and the picking control unit 60. The selection signal generation unit 32 may be structured through use of an existing device provided on the loom; e.g., a controller of the shedding device. In more detail, if the loom is provided with a shedding device capable of electrically selecting a shedding frame or another shedding device such as a so-called electronic dobby or jacquard, the number-of-rotations selection signals and the weft selection signal may be output through the use of a selection signal output function which is provided in a controller of such a shedding device.

In the present embodiment, the drive unit 40 which drives the loom on the basis of a number-of-rotations pattern selected according to an input number-of-rotations selection signal includes a number-of-rotations setting device 41, a number-of-rotations instruction device 42, and an inverter 44. A plurality of number-of-rotations patterns used for instructing the loom are set in the number-of-rotations setting device 41, and the respective patterns are delivered to the number-of-rotations instruction device 42. The number-of-rotations instruction device 42 converts the number-of-rotations pattern into a speed instruction pattern used for instructing the motor 48. The speed instruction patterns are stored so as become associated with the respective number-of-rotations signals RD1, RU1, RT1, . . . , RTm. On the basis of the number-of-rotations pattern selected according to the input number-of-rotations selection signals, the number-of-rotations instruction device 42 can output a motor speed instruction "v" to the inverter 44. On the basis of this motor speed instruction, the inverter 44 drives the motor 48 by feeding required power. By means of the above-described drive unit 40, the loom can be driven by means of the motor 48 until the loom assumes the number-of-rotations pattern set in the number-of-rotations instruction device 42. In the event of a reduction in the number of rotations, if the inverter 44 cannot sufficiently decelerate the loom, supplemental braking forces may be applied to the loom by means of a brake 50 connected to the spindle, by way of a brake circuit 46 attached to the drive unit 40.

The picking control unit 60 includes a main control unit 62, a timing controller 66, and a pressure controller 68. Further, a picking condition setting device 64 is connected to the main control unit 62. In the picking condition setting device 64, there are set control data regarding the measuring members and the picking nozzles which constitute picking conditions; namely, the timings at which the lock pin 14 advances or recedes, which are set so as to correspond to the crank angle signal θ of the loom; the timings at which the main nozzle 15 and the sub-nozzle 16 commence and stop squirting action; and squirting pressures of the respective picking nozzles. The control data is set so as to become associated with the weft selection instruction and the number-of-rotations selection instruction. The picking control unit 60 sends these preset picking conditions to the main control unit 62.

The main control unit 62 sets the preset picking conditions received from the picking condition setting device 64 so as to associate the same with the weft selection signals CL1, . . . , CLn and the number-of-rotations selection signals RD1, RU1, RT1, . . . , RTm and stores the thus-set picking conditions. The main control unit 62 selects preset picking conditions according to the weft and number-of-rotations selection signals delivered from the selection signal generator 38. On the basis of the thus-selected picking conditions, the main control unit 62 sends to the timing controller 66 and the pressure controller 68 operation instructions to be sent to the individual picking members, so as to correspond to the crank angle signal θ received from the encoder 20. As shown in FIG. 1, in accordance with the operation instructions, the timing controller 66 outputs drive signals to the respective lock pins 14 and the electromagnetic valves 22, . . . , 22. Further, the pressure controller 68 outputs pressure instructions to the individual pressure regulators 24. As mentioned above, on the basis of the picking conditions set in the picking condition setting device 64, the lock pins 14 and the picking nozzles, which together constitute the picking apparatus, are respectively activated. In the main control unit 62, for example, a microprocessor or memory for storing computation procedures relating to control is built. The main control unit 62 can effect control of activation of the loom and control of tension of warps, as well as picking control.

The weft selection instruction and the number-of-rotations selection instruction every picking operation are set in the selection instruction setting device 37 so as to correspond to the picking number. Further, the number-of-rotations instruction pattern is set in the number-of-rotations setting device 41 in accordance with the number-of-rotations selection signal received from the selection instruction setting device 37. In the number-of-rotations instruction pattern, a plurality of patterns for maintaining the number of rotations at a constant number of rotations and a plurality of patterns for increasing or decreasing the number of rotations with lapse of time are set in selection phase, that is, one picking phase, so as to correspond to the changeover among the wefts. The number-of-rotations instruction device 42 can change the number of rotations of the loom on the basis of the number-of-rotations pattern selected by means of the number-of-rotations selection signal. Picking conditions are set in the picking condition setting device 64 so as to correspond to the weft selection instruction and the number-of-rotations selection instruction received from the selection instruction setting device 37. Under the picking conditions selected on the basis of the weft selection signal and the number-of-rotations selection signal, the main control unit 62 activates the individual picking members; namely, individual picking nozzles and measuring members, and performs picking operations.

FIRST EXAMPLE

Next, a description will be given of a specific example that two types of wefts having different traveling characteristics are continuously picked on every warp in units having a predetermined number of picks and that the number of rotations of the loom is changed in response to changeover between the wefts. More specifically, assume that a weft "b" that travels with difficulty is picked "k" times after a weft "a" that travels easily is picked "i" times and that the weft "a" is further picked "n" times (where "i" is an integer greater than 2, and "k" and "n" each represent an integer greater than 1). An example of a picking cycle having i+k+n picks will be considered. Specifically, the loom is decelerated to a small number of rotations corresponding to the weft "b" from a large number of rotations corresponding to the weft "a" in one pick before the weft "a" is switched to the weft "b." After the weft "b" has been picked "k" times while the small number of rotations is maintained, the weft "a" is picked while the loom is accelerated to the number of rotations corresponding to the weft "a" during one pick.

Figure 3:
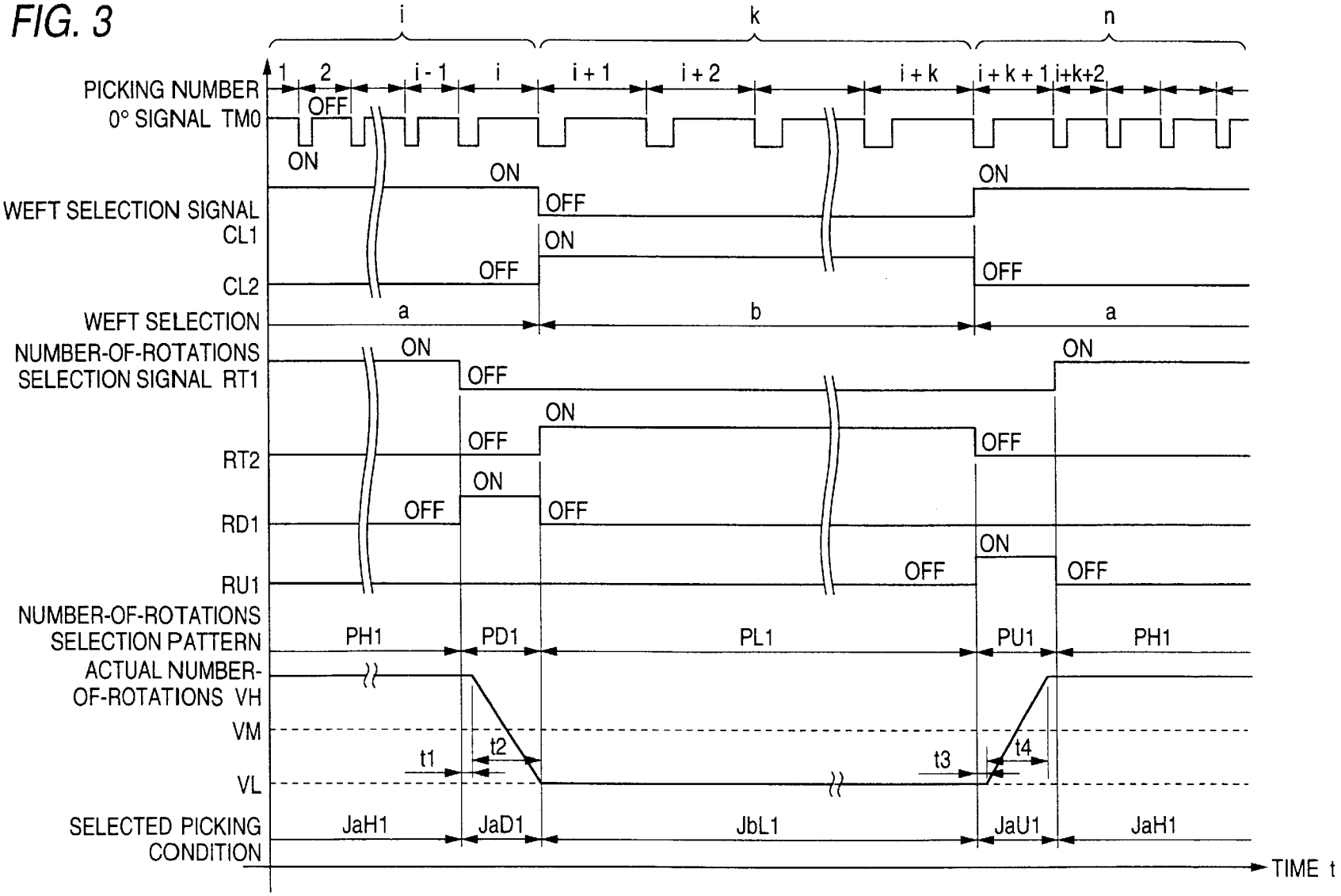
FIG. 3 is a timing chart showing the operation of the picking apparatus according to the first example of the present invention.

A selection instruction for outputting the weft selection signals CL1 and CL2 and a selection instruction for outputting the number-of-rotations signal RD1, RU1, RT1, and RT2 are previously set in the form of a pattern in the selection instruction setting device 37 for each pick so as to correspond to the respective picking numbers from 1 to i+k+n. The selection signal generator 38 stores a selection instruction pattern issued by the selection instruction setting device 37 and outputs selection signals corresponding to the picking number to be counted, as shown in FIG. 3. Detailed explanation of the settings of the selection instruction setting device 37 is omitted here, and instead the waveforms of the selection signals output from the selection signal generator 38 are shown in FIG. 3.

The number-of-rotations patterns corresponding to the number-of-rotations selection instructions set in the selection instruction setting device 37 are set in the number-of-rotations setting device 41. In connection with the number-of-rotations instruction pattern, a number-of-rotations pattern for maintaining the number of rotations constant for a period of selection or a period of single picking and another number-of-rotations pattern for increasing or decreasing the number of rotations with lapse of time so as to correspond to selection among the wefts can be set in a plurality of patterns. More specifically, in the number-of-rotations setting device 41, there are set, as a number-of-rotations pattern for a single picking phase, a number-of-rotations pattern PH1 for maintaining a large number of rotations VH in order to continuously operate the loom at high speed through use of the weft "a" that travels easily; a number-of-rotations PL1 for maintaining a small number of rotations VL in order to continuously operate the loom at low speed through use of the weft "b" that travels with difficulty; a number-of-rotations PD1 for decelerating the loom from the large number of rotations VH to the small number of rotations VL before the weft "a" is switched to the weft "b"; and a number-of-rotations pattern PU1 for accelerating the loom from the small number of rotations VL to the large number of rotations VH when the weft "b" is switched to the weft "a." The number-of-rotations setting device 41 sends these number-of-rotations patterns to the number-of-rotations instruction device 42.

The number-of-rotations instruction device 42 stores these number-of-rotations patterns so as to associate the same with the respective number-of-rotations selection signals RT1, RT2, RD1, and RU1. On the basis of the number-of-rotation pattern selected according to the number-of-rotations selection signal that is received from the selection signal generator 38, the number-of-rotations instruction device 42 can change the number of rotations of the loom with lapse of time.

A plurality of picking conditions corresponding to the number-of-rotations selection instruction and the weft selection instruction are set in the picking condition setting device 64. The main control unit 62 stores the picking conditions so as to associate the same with the weft selection signal and the number-of-rotations selection signal. The setting of the picking conditions will be described later.

The actual operations of the above-described control block during operation of the loom will now be described with reference to FIG. 3. In the drawing, the horizontal axis represents time, and the vertical axis represents individual signal levels. A 0° signal is output at a low level by an unillustrated signal generator every time the crank angle of the spindle passes through 0° at which beating-up action is effected.

For example, when the picking number 1 is counted, the selection signal generator 38 turns ON and outputs the weft selection signal CL1 for selecting the weft "a" that travels easily and the number-of-rotations selection signal RT1 for driving the loom at a large number of rotations. Since the number-of-rotations selection signal RT1 is in an ON state, the number-of-rotations instruction device 42 selects a corresponding number-of-rotations pattern; i.e., the number-of-rotations pattern PH1 for constantly maintaining the large number of rotations. By means of the number-of-rotations pattern, the speed instruction "v" is output, and the actual number of rotations of the loom is maintained at the large number of rotations VH.

In one pick before the weft "a" is switched to the weft "b"; namely, when picking number "i" is counted, the selection signal generator 38 turns OFF the number-of-rotations selection signal RT1 and turns ON the number-of-rotations selection signal RD1 by means of the pattern set in the selection instruction setting device 37 so as to correspond to the picking number. According to the number-of-rotations selection signal RD1, the number-of-rotations instruction device 42 selects a corresponding number-of-rotations pattern; i.e., the number-of-rotations pattern PD1 for decelerating the loom from the large number of rotations VH to the small number of rotations VL corresponding to the weft "b" with lapse of time. As a result, as shown in FIG. 3, by means of the thus-selected number-of-rotations pattern PD1, the loom is gradually decelerated from the large number of rotations VH to the small number of rotations VL during a single picking phase.

After the weft "a" is picked during the deceleration of the loom, the picking number i+1 is counted, and the selection signal generator 38 turns OFF the weft selection signal CL1, and turns ON and outputs the weft selection signal CL2. Further, the selection signal generator 38 turns OFF the number-of-rotations selection signal RD1, and turns ON and outputs the number-of-rotations selection signal RT2. According to the number-of-rotations selection signal RT2, the number-of-rotations instruction device 42 selects the corresponding number-of-rotations pattern PL1. On the basis of the thus-selected number-of-rotations pattern PL1, the actual number of rotations of the loom is constantly maintained at the low number of rotations VL.

After picking of the weft "b" corresponding to the picking number "k," a picking number i+k+1 is counted. In order to switch the weft "b" to the original weft "a,", the selection signal generator 38 turns OFF the weft selection signal CL2 and turns ON and outputs the weft selection signal CL1, as well as turning OFF the number-of-rotations selection signal RT2 and turning ON and outputting the number-of-rotations selection signal RU1. According to the number-of-rotations selection signal RU1, the number-of-rotations instruction device 42 selects the corresponding number-of-rotations pattern PU1. As shown in FIG. 3, the loom is gradually accelerated from the number of rotations VL to the number of rotations VH during a single picking phase by means of the number-of-rotations pattern.

After picking of the weft "a" during acceleration, a picking number i+k+2 is counted. The selection signal generator 38 turns OFF the number-of-rotations selection signal RU1 and turns ON and outputs the number-of-rotations selection signal RT1. According to the number-of-rotations selection signal RT1, the number-of-rotations instruction device 42 selects the corresponding number-of-rotations pattern PH1 and maintains the actual number of rotations of the loom at the number of rotations VH. In subsequent operations, the picking number is counted sequentially, and the number of rotations is changed according to the selected weft. The thus-selected weft is picked. After completion of one repetition, that is the picking relating from picking number 1 to the picking number i+k+n, the picking number is reset to its initial value 1, and the loom returns to its original state and can continue its operations.

During a single picking phase, the loom has a period of time during which warps are shed in association with rotation of the loom, and picking of the weft can be physically effected by means of injection of the picking nozzles; namely, a pickable phase. Picking conditions are set so that the picking members; that is, the picking nozzles and the lock pins, are operated at least within the range of the pickable phase. Further, depending on the number-of-rotations pattern which is selected in response to changeover among the wefts, the change pattern in the actual number of rotations of the loom during the pickable phase is also changed. For this reason, during the picking phase in which the number of rotations is changed, in order to ensuring picking of the selected weft, there are set picking conditions corresponding to the selected weft as well as to the change pattern in the number of rotations. The number of rotations of the loom is changed in accordance with the number-of-rotations selection instruction. The picking conditions are set and stored so as to become associated with the weft selection instruction and the number-of-rotations selection instruction. For example, the pickable phase changes according to the settings of the amount to which the shedding device is shed, a shedding curve, cross-timing, and setting of a relative position of a warp travel path, and settings regarding the positions on the loom where the picking nozzles are mounted. In FIGS. 3 through 6, the pickable phase ranges between the spindle crank angles of 50° and 290°.

In a setting device of the picking apparatus; namely, the picking condition setting device 64, picking conditions are set so as to become associated with the weft selection instruction and the number-of-rotations instruction received from the selection instruction setting device 37. More specifically, during a period from picking number 1 to i−1 and a period from picking number i+k+2 to i+k+n, the weft "a" is selected, and the number-of-rotations pattern PH1 is selected so that the actual number of rotations of the loom is maintained at the larger number of rotations VH. Thus, picking conditions JaH1 are set as the corresponding picking conditions. During the period from picking number of i+1 to picking number of i+k, the weft "b" is selected, and the number-of-rotations PL1 is selected so that the actual number of rotations of the loom is maintained at the small number of rotations VL. As a result, picking conditions JbL1 are set as the corresponding picking conditions.

Figure 4:
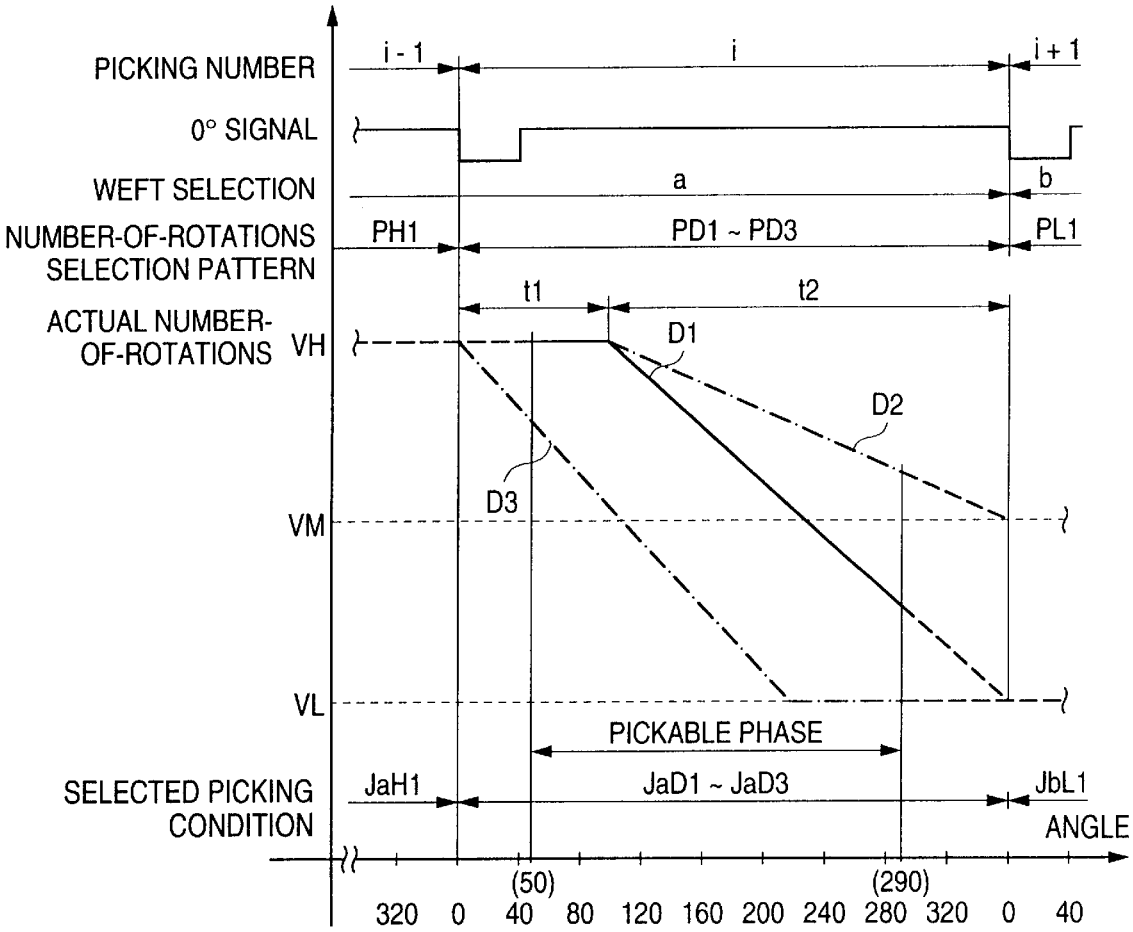
FIG. 4 is a timing chart showing the change pattern in the number of rotations during a pickable phase in the picking apparatus according to the first to third examples of the present invention.

When the number of rotations of the loom is changed to the small number of rotations VL from the large number of rotations VH or vice versa, picking conditions are set so as to correspond to the weft selection instruction and the number-of-rotations selection instruction received from the selection instruction setting device 37. As shown in FIG. 4, when the loom is decelerated at picking number "i" from the large number of rotations VH to the small number of rotations VL, the weft "a" is selected. Further, since the number-of-rotations selection signal RD1 is input, the number-of-rotations pattern PD1 which maintains the large number of rotations VH at time period (time) t1 and decelerates the loom to the target number of rotations VL at subsequent time period (time) t2, is selected. The change pattern in the number of rotations during the pickable phase assumes the form of a line designated by D1 of FIG. 4. Picking conditions JaD1 are set as conditions corresponding to the selected weft "a" and to the pattern D1 of a change in the number of rotations.

At the time of acceleration of the loom; that is, at the picking number of i+k+1, the weft "a" is selected, and the loom is accelerated from the small number of rotations VL to the large number of rotations VH by selection of the number-of-rotations pattern PU1. During the pickable phase, the change pattern in the number of rotations assumes the form of an unillustrated line designated by U1, and picking conditions JaU1 are set as conditions corresponding to the weft "a" and the pattern U1 of a change in the number of rotations.

Next, a description will be given of the setting of the picking conditions corresponding to the selected weft and to the change pattern in the number of rotations in a pickable phase during the course of changing the number of rotations, in detail. For instance, when the loom is decelerated from the large number of rotations VH to the small number of rotations VL, such as at picking number "i", the period of injection becomes longer as a result of deceleration, provided that the picking conditions are set in accordance with the original large number of rotations VH. Further, by means of the pressure of injection by the picking nozzles corresponding to the large number of rotations, the weft travels at a timing faster than that originally expected. In such a case, even when the leading end of the weft arrives at the vicinity of the side opposite to the picking side, the warps are not yet shed or the sub-nozzles have not yet started squirting operations, thereby decreasing the travel speed of the leading end of the weft. As a result, the leading end of the weft is caught by the warps in the shed, thus resulting in a picking failure or so-called bend picking. Further, even after arrival at the end of the woven cloth, the weft "a" is exposed to a jet of air for a long period of time, with the result that the weft "a" may be broken by the jet.

To prevent such a bend picking problem, picking conditions used during deceleration of the loom; i.e., the picking conditions JaD1 to JaD3 shown in FIG. 4 are set such that the weft arrives at the end of the woven cloth substantially at the same timing as that at which the weft arrives at a high-speed operation. Specifically, the above picking conditions are attained, e.g., by delaying the timing at which traveling of the weft is commenced or the speed at which the weft travels. As a specific setting of the picking condition which delays the timing at which traveling of the weft is commenced, there is proposed a measure such that the timing at which the weft is released from the lock pins 14 or the timing at which the picking nozzles commence squirting operations is delayed. Further, as the setting of the picking condition for delaying the speed at which the weft travels, there is proposed a measure which changes the timing at which each of the picking nozzles squirts air in a relaying manner, or reduces the pressure at which the picking nozzles squirt fluid so as to shorten the period over which the picking nozzles perform squirting operations. Moreover, there is proposed a squirting timing setting which changes continuous squirting action of the picking nozzles to intermittent squirting action.

Conversely, when the loom is accelerated from a small number of rotations to a large number of rotations, such as picking number "i+k+1", the injection period becomes shorter as a result of acceleration, provided that the picking conditions are set to the original small number of rotations. Further, the picking nozzles provide only insufficient injection pressure, so that the weft travels at a timing slower than that originally expected. As a result, there may arise a picking failure in which the weft fails to arrive at the side of the woven cloth opposite to the picking side during the pickable phase. To prevent such a picking failure, picking conditions used during acceleration of the loom; i.e., the picking condition JaU1 shown in FIG. 3 are set such that the weft arrives at the end of the woven cloth substantially at the same timing as that at which the weft arrives at a high-speed operation. The above picking condition is achieved, for example, by speeding up the timing at which traveling of the weft is commenced or the speed at which the weft travels. As the specific setting of the picking condition for speeding up the timing at which traveling of the weft is commenced, there is proposed a measure which speeds up the timing at which the weft is released from the lock pins 14 or the timing at which the picking nozzles commence squirting action. Further, as the specific setting of the picking condition for speeding up the speed at which the weft travels, there is proposed a measure which increases the period over which the picking nozzles perform squirting action, or increases the pressure at which the picking nozzles squirt fluid.

In other words, desirably the picking conditions corresponding to the change pattern in the number of rotations in a pickable phase during the course of changing the number of rotations include at least one of the timing at which the picking nozzles squirts fluid, the pressure at which a fluid is squirted by the picking nozzles, and the timing at which the weft is released from the measuring device (by means of the lock pin 14).

Conceivably, the picking conditions corresponding to the change pattern in the number of rotations can be set in various other ways. Preferably, in the case of deceleration of the loom such as at picking number "i", the period during which the picking nozzles disposed in the vicinity of the end of the woven cloth perform squirting action becomes longer as the loom is decelerated. Therefore, the conceivable setting of the picking condition for adjusting with the period include a measure which shortens the period during which the sub-nozzles 16 perform squirting action as the sub-nozzles 16 are disposed closer to the end of the woven cloth, and a measure which gradually decreases the pressure at which the picking nozzles perform squirting action. In contrast, in the case of acceleration of the loom such as at picking number "i+k+1", the conceivable setting of the picking conditions include reversing the foregoing setting of the picking conditions. As a matter of course, even if acceleration and deceleration employ pickable phases of the same overall length (time), the period (of time) during which the picking members operate differs according to the number of rotations. Therefore, more preferably, the picking conditions are respectively set so as to become optimum conditions for acceleration or deceleration.

The setting of picking conditions corresponding to the change pattern in the number of rotations may be simplified. In other words, a mean number of rotations between the number of rotations before changing and a target number of rotations is adopted, and there may be employed a picking condition under which the loom is continuously operated at the thus-obtained number of rotations. Picking conditions may be set by use of the foregoing methods singly or in combination of two or more methods.

As mentioned above, in the multicolor picking loom which changes the number of rotations of a loom according to the selected weft, a weft can be picked during the course of changing the number of rotations of the loom under picking conditions which are previously set so as to correspond to the selected weft and to the change pattern in the actual number of rotations in a pickable phase during the course of changing the number of rotations. Specifically, even if the number of rotations of the loom is changed abruptly, optimum picking conditions can be set in consideration of the change pattern in the number of rotations during the pickable phase, without involvement of so-called follow-up control for setting conditions. Therefore, the selected weft can be reliably picked, thereby preventing a picking failure which would otherwise be caused by the conventional technique and greatly improving the productivity of a woven cloth.

More preferably, the picking conditions corresponding to the selected weft and to the change pattern in the number of rotations in a pickable phase during the course of changing the number of rotations may be corrected according to the actual timing at which the weft travels. For instance, a weft detection signal issued by the weft feeler 26 which is disposed along the travel path of the weft is input to the main control unit 62, and from the crank angle signal θ, the main control unit 62 can calculate the timing at which the weft arrives. Picking conditions received from the picking condition setting device 64 may be corrected on the basis of a deviation between the target value and the actual timing at which the weft arrives; namely, a deviation from the arrival timing. The thus-corrected picking conditions are adopted at true setting values at the time of selection of the next picking conditions, thereby rendering picking conditions closer to optimum in conjunction with progress in the weaving operation.

With the above-described setting of the picking conditions, the picking conditions entered by the picking condition setting device 64 are set and stored in the main control unit 62 so as to become associated with the weft selection signal and the number-of-rotations selection signal. Further, the main control unit 62 can select picking conditions so as to correspond to the weft select signal and the number-of-rotations selection signal and can pick the weft to be selected. More specifically, during a period from picking number 1 to picking number i−1, the weft "a" is selected, and the actual number of rotations of the loom is maintained at the large number of rotations VH. Accordingly, the main control unit 62 selects the picking conditions JaH1 corresponding to the weft selection signal CL1 and the number-of-rotations selection signal RT1, both of which are received from the selection signal generator 38. The weft "a" is picked under the picking conditions JaH1. Subsequently, when picking number "i" is counted, the weft "a" is selected, and the loom is decelerated from the large number of rotations VH to the small number of rotations VL. Accordingly, the main control unit 62 selects the picking conditions JaD1 corresponding to the weft "a" and the pattern Dl of a change in the number of rotations according to the weft selection signal CL1 and the number-of-rotations selection signal RD1, both of which are received from the selection signal generator 38. The weft "a" is picked under the picking conditions JaD1.

Subsequently, during a period from picking number i+1 to i+k, the weft "b" is selected, and the actual number of rotations of the loom is maintained at the low number of rotations VL. Accordingly, the main control unit 62 selects the picking conditions JbL1 corresponding to the weft selection signal CL2 and the number-of-rotations selection signal RT2, both of which are received from the selection signal generator 38. The weft "b" is picked under the picking conditions JbL1. When picking number i+k+1 is counted, the weft "a" is selected, and the loom is accelerated to the large number of rotations VH from the small number of rotations VL. The main control unit 62 selects the picking conditions JaU1 corresponding to the weft "a" and the unillustrated pattern U1 of a change in the number of rotations according to the weft selection signal CL1 and the number-of-rotations selection signal RU1, both of which are received from the selection signal generator 38. As in the case with the period from picking number 1 to picking number i−1, during a period from picking number i+k+2 to picking number i+k+n, the weft "a" is selected, and the actual number of rotations of the loom is maintained at the large number of rotations VH. The main control unit 62 selects the corresponding picking conditions JaH1 according to the weft selection signal CL1 and the number-of-rotations selection signal RT1, both of which are received from the selection signal generator 38. The weft "a" can be picked under the picking conditions JaH1.

As mentioned above, in the loom which changes the number of rotations in response to changeover between the wefts, picking conditions are set in advance so as to correspond to the change pattern in the number of rotations in the pickable phase during the course of changing the number of rotations and to the selected weft. When the number of rotations is changed in response to changeover between the wefts, picking conditions corresponding to the selected weft and the change pattern in the number of rotations are selected according to the weft selection signal and the number-of-rotations selection signal, while the number of rotations of the loom is changed according to the selected number-of-rotations pattern. The selected weft can be picked under the thus-selected picking conditions.

SECOND EXAMPLE

Various modifications of the number-of-rotations pattern set in response to changeover between the wefts are conceivable. Particularly, parameters used for setting a number-of-rotations pattern when the number of rotations is changed include, e.g., a target number of rotations and periods t1 and t2 required for changing the number of rotations to the target number of rotations (see FIG. 4). Although in the first example, the wefts "a" and "b" are picked, the second example describes, in place of picking of the weft "b," picking of a weft "c" that is picked slightly more easily than the weft "b". Since the weft "c" travels slightly more easily than the weft "b", the number of rotations of the loom required for the weft "c" can be determined as VM, which is slightly greater than the number of rotations VL required for the weft "b."

Figure 5:
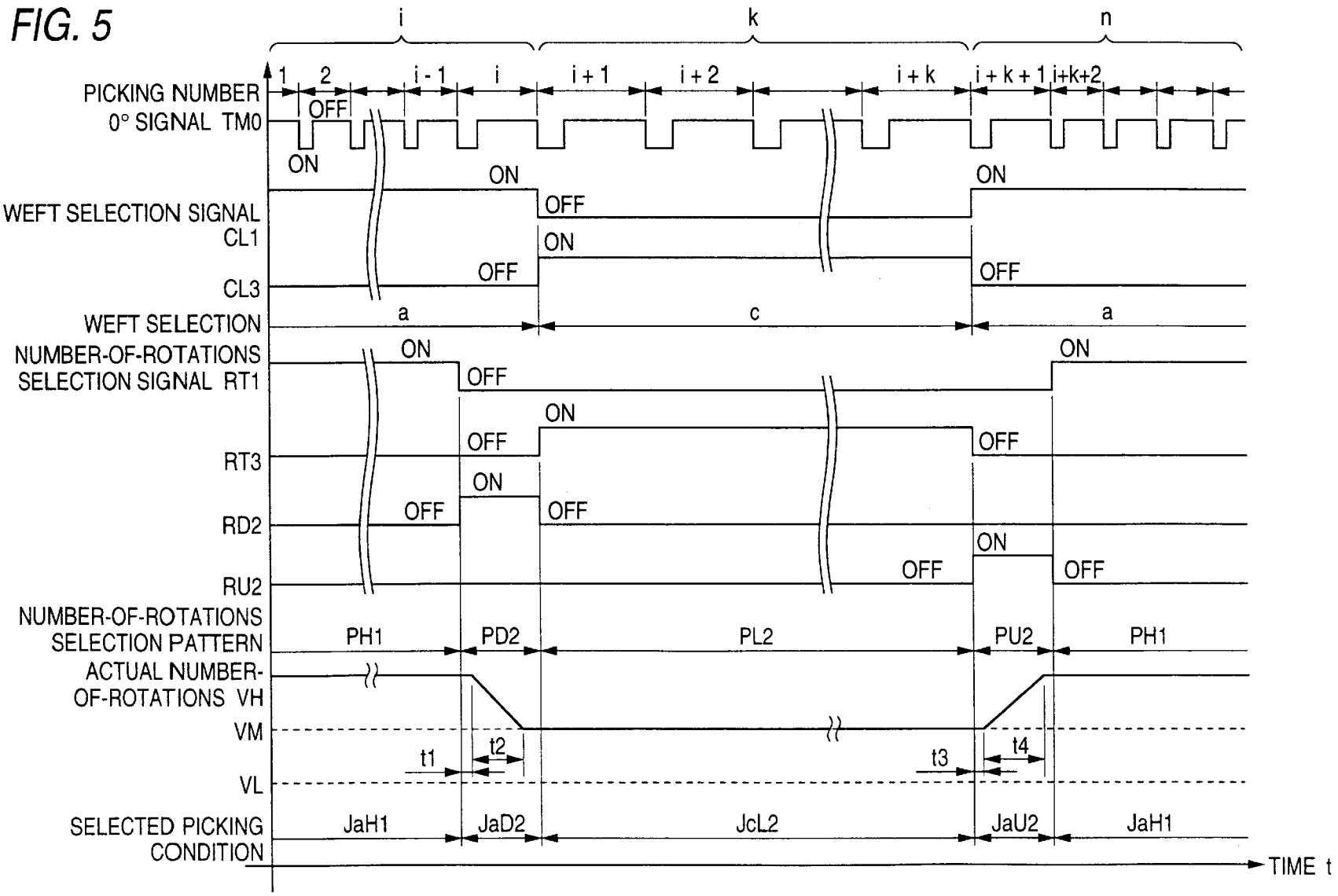
FIG. 5 is a timing chart showing the operation of a picking apparatus according to a second example of the present invention.

More specifically, selection instructions used for outputting the weft selection signal CL1 corresponding to the selected weft "a" and the weft selection signal CL3 corresponding to the selected weft "c" and selection instructions used for outputting the number-of-rotations selection signals RD2, RU2, RT1 and RT3 are previously set in the selection instruction setting device 37 in the form of a pattern so as to correspond to picking numbers 1 through i+k+n. The selection instruction patterns received from the selection instruction setting device 37 are stored in the selection signal generator 38. As shown in FIG. 5, the selection signal generator 38 outputs each of the selection signals corresponding to the picking number to be counted. The selection instruction generator 38 outputs the number-of-rotations selection signals RD2, RU2, RT1 and RT3 to the number-of-rotations instruction device 42 and the main control unit 62.

More specifically, the number-of-rotations patterns for a single picking phase are respectively set in the number-of-rotations setting device 41 so as to correspond to the number-of-rotations selection instruction. For example, in the number-of-rotations setting device 41, there are set, as number-of-rotations patterns for a single picking phase, a number-of-rotations pattern PH1 for maintaining the large number of rotations VH in order to continuously operate the loom at high speed through use of the weft "a" that travels easily; a number-of-rotations pattern PL2 for maintaining the small number of rotations VM in order to continuously operate the loom at low speed through use of the weft "c" that travels with relative difficulty; a number-of-rotations PD2 for decelerating the loom from the large number of rotations VH to the small number of rotations VM before the weft "a" is switched to the weft "c"; and a number-of-rotations pattern PU2 for accelerating the loom from the small number of rotations VM to the large number of rotations VH when the weft "c" is switched to the weft "a" . The number-of-rotations setting device 41 sends these number-of-rotations patterns to the number-of-rotations instruction device 42. The number-of-rotations instruction device 42 stores these number-of-rotations patterns so as to associate with the respective number-of-rotations selection signals RT1, RT3, RD2, and RU2. On the basis of the number-of-rotation pattern selected according to the number-of-rotations selection signal that is received from the selection signal generator 38, the number-of-rotations instruction device 42 can change the number of rotations of the loom every picking operation with lapse of time. More specifically, the actual number of rotations of the loom can be changed so as to follow a line shown in FIG. 5.

Further, in the picking condition setting device 64, picking conditions corresponding to the selected weft and the change pattern in the number of rotations during the pickable phase are set. More specifically, during the period from picking number 1 to picking number i−1 and the period from picking number i+k+2 to picking number i+k+n, the weft "a" is selected, and the actual number of rotations of the loom is maintained at the large number of rotations VH by selection of the number-of-rotations pattern PH1. Accordingly, the corresponding picking conditions JaH1 are set in the picking condition setting device 64. During the period from picking number i+1 to picking number i+k, the weft "c" is selected, and the actual number of rotations of the loom is maintained at the small number of rotations VM by selection of the number-of-rotations pattern PL2. Accordingly, the corresponding picking conditions JcL2 are set in the picking condition setting device 64.

When the number of rotations of the loom is switched from the large number of rotations VH to the small number of rotations VM, or vice versa, in response to changeover between the wefts, the picking conditions corresponding to the selected weft, the change pattern in the number of rotations during the pickable phase, are set in the picking condition setting device 64. More specifically, when the loomis decelerated at picking number "i" from the large number of rotations VH to the small number of rotations VM, the weft "a" is selected, and the number-of-rotations pattern PD2 in which the number of rotations of the loom is maintained at the large number of rotations VH at time t1 and is decelerated to the target number of rotations VM at time t2 is selected upon receipt of the number-of-rotations selection signal RD1. The actual number of rotations of the loom; i.e., the change pattern in the number of rotations during the pickable phase, represents the form of a line designated by D2 of FIG. 4. Accordingly, the picking condition JaD2 is set as picking conditions corresponding to the selected weft "a" and the pattern D2 of a change in the number of rotations. Further, when the loom is accelerated; namely, when picking number i+k+1 is counted, the weft "a" is selected, and the loom is accelerated from the small number of rotations VM to the large number of rotations VH by selection of the number-of-rotations pattern PU2. During the pickable phase, the change pattern in the number of rotations represents the form of a line designated by U2 (not shown). Accordingly, the picking condition JaU2 are set in the picking condition setting device 64 as picking conditions corresponding to the selected weft "a" and the pattern U2 of a change in the number of rotations.

The picking conditions set in the picking condition setting device 64 are set and stored in the main control unit 62 so as to become associated with the weft selection signal and the number-of-rotations selection signal. Further, the main control unit 62 can select picking conditions corresponding to the weft selection signal and the number-of-rotations selection signal and pick the thus-selected weft. More specifically, during the period from picking number 1 to picking number i−1, the weft "a" is selected, and the actual number of rotations of the loom is maintained at the large number of rotations VH. Accordingly, the main control unit 62 selects the corresponding picking conditions JaH1 according to the weft selection signal CL1 and the number-of-rotations selection signal RT1, both of which are received from the selection instruction generator 38, and picks the weft "a" under the picking conditions JaH1. Next, picking number "i" is counted, and the weft "a" is selected, and the loom is decelerated from the large number of rotations VH to the small number of rotations VM. Therefore, the main control unit 62 selects the picking conditions JaD2 corresponding to the weft "a" and the pattern D2 of a change in the number of rotations according to the weft selection signal CL1 and the number-of-rotations selection signal RD2, both of which are received from the selection instruction generator 38. The weft "a" is picked under the picking conditions JaD2.

Subsequently, during the period from picking number i+1 to picking number i+k, the weft "c" is selected, and the actual number of rotations of the loom is maintained at the small number of rotations VM. Accordingly, the main control unit 62 selects corresponding picking conditions JcL2 according to the weft selection signal CL3 and the number-of-rotations selection signal RT3, both of which are received from the selection instruction setting device 37, and picks the weft "c" under the picking conditions JcL2. When picking number i+k+1 is counted, the weft "a" is selected, and the loom is accelerated from the small number of rotations VM to the large number of rotations VH. Accordingly, the main control unit 62 selects picking conditions JaU2 corresponding to the weft "a" and the pattern U2 of a change in the number of rotations according to the weft selection signal CL1 and the number-of-rotations selection signal RU2, both of which are received from the selection instruction generator 38, and picks the weft "a" under the picking conditions JaU2. As in the case with the period from picking number 1 to picking number i−1, during a period from picking number i+k+2 to picking number i+k+n, the main control unit 62 selects the weft "a" and maintains the actual number of rotations of the loom at the large number of rotations VH. The main control unit 62 selects the corresponding picking conditions JaH1 according to the weft selection signal CL1 and the number-of-rotations selection signal RT1, both of which are received from the selection instruction generator 38, and can pick the weft "a" under the picking conditions JaH1. As mentioned above, in the loom which changes the number of rotations in response to changeover between the wefts, picking conditions are selected in advance so as to correspond to the change pattern in the number of rotations in the pickable phase during the course of changing the number of rotations and to the selected weft. When the number of rotations is changed in response to changeover between the wefts, picking conditions corresponding to the selected weft and the change pattern in the number of rotations are selected according to the weft selection signal and the number-of-rotations selection signal, while the number of rotations of the loom is changed according to the selected number-of-rotations pattern. The selected weft can be picked under the thus-selected picking conditions.

Incidentally, the specific setting of the picking conditions is the same as that of the first example.

THIRD EXAMPLE

The second example has described the case where the target number of rotations, which is a parameter of the number-of-rotations pattern, is changed. The same applies to the setting of another parameter; that is, a period during which the number of rotations is changed. For example, in connection with the first example in which the number of rotations is changed from the large number of rotations VH to the small number of rotations VL, there will now be considered a case where the period tl during which the current number of rotations is maintained is set to zero in relation to the number-of-rotations pattern PD1 for decelerating the loom from the large number of rotations VH to the small number of rotations VL.

Figure 6:
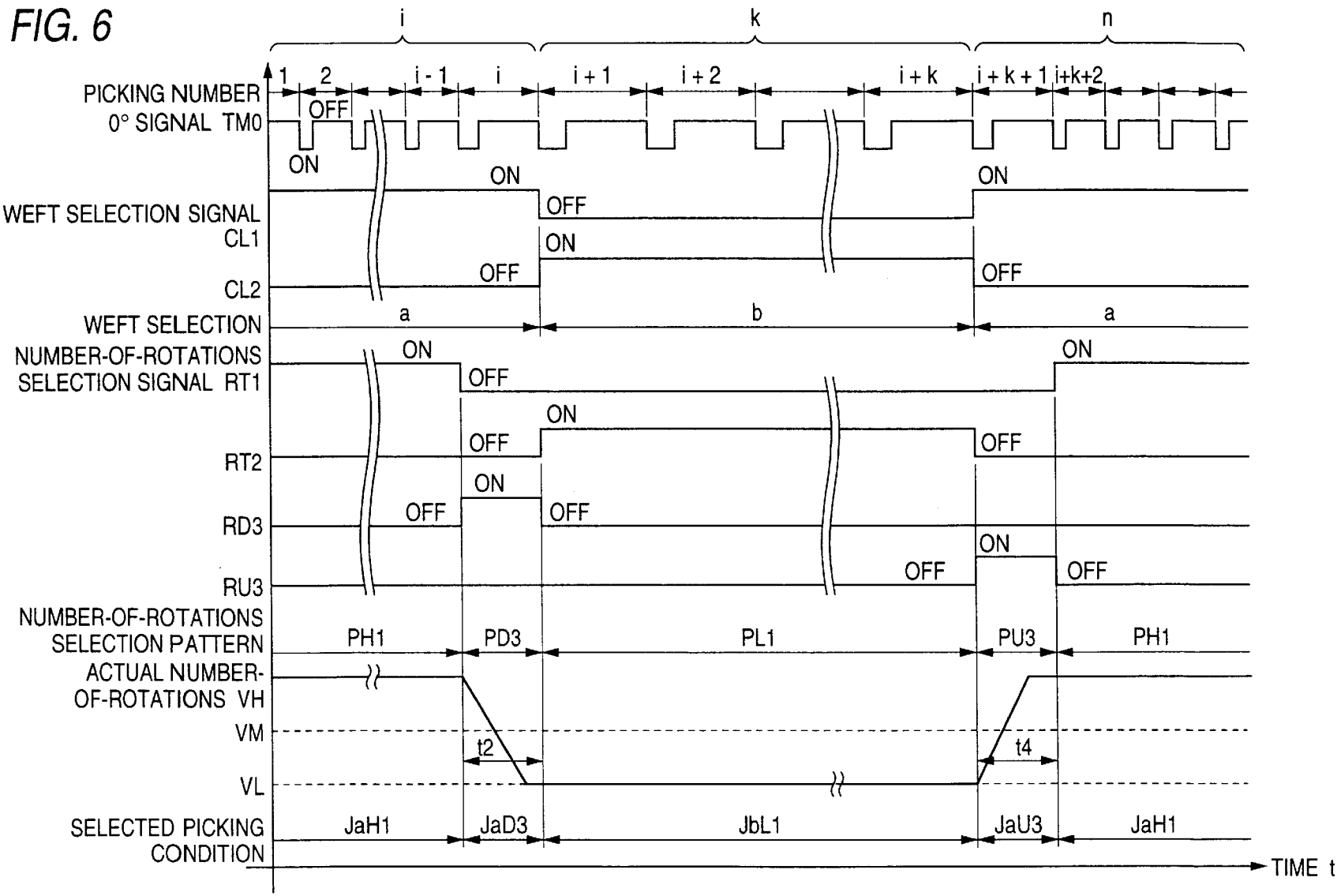
FIG. 6 is a timing chart showing the operation of a picking apparatus according to a third example of the present invention.

As shown in FIG. 6, selection instructions for outputting the weft selection signal CL1 corresponding to the weft "a" and the weft selection signal CL2 corresponding to the weft "b" and selection instructions for outputting the number-of-rotations selection signals RD3, RU3, RT1, and RT2 are previously set in the selection instruction generator 38 for each pick, in the form of a pattern so as to correspond to the respective picking numbers. At picking number "i," the selection instruction generator 38 can output the selection weft signal CL1 for the purpose of picking the weft "a" and output the number-of-rotations selection signal RD3 for the purpose of decelerating the loom from the large number of rotations VH to the small number of rotations VL. Further, the selection instruction setting device 37 outputs number-of-rotations selection signals RD3 and RU3 to the selection instruction generator 38. The selection instruction generator 38 outputs these signals to the number-of-rotations instruction device 42 and the main control unit 62. In contrast with the settings of the number-of-rotations setting device 41 performed in the first example shown in FIG. 3, a number-of-rotations pattern PD3 based on the setting in which the period t1 is 0 and the period t2 is maintained as it is, is set in advance, over the single picking period in the number-of-rotations setting device 41. The number-of-rotations instruction device 42 stores the number-of-rotations pattern so as to associate with the selection signal RD3. Thus, when picking number "i" is counted, the number-of-rotations instruction device 42 selects the number-of-rotations pattern PD3 in accordance with the number-of-rotations selection signal RD3 that is received from the selection instruction generator 38. As a result, the loom is decelerated, and the change pattern in the number of rotations during a pickable phase represents the form of a line designated by D3 of FIG. 4.

In the picking condition setting device 64, there are previously set picking conditions corresponding to picking number "i"; that is, the picking conditions JaD3 corresponding to the selected weft "a" and to the pattern D3 of a change in the number of rotations during the pickable phase. The picking conditions JaD3 are sent to the main control unit 62. The main control unit 62 stores the thus-received picking conditions JaD3 so as to associate with the weft selection instruction and the number-of-rotations instruction. At picking number "i," the weft "a" is selected, and the loom is decelerated from the large number of rotations VH to the small number of rotations VL. Therefore, the main control unit 62 selects the picking conditions JaD3 corresponding to the weft "a" and to the pattern D3 of a change in the number of rotations according to the weft selection signal CL1 and the number-of-rotations selection signal RD3. As a result, the selected weft "a" can be picked under the picking conditions JaD3.

The number-of-rotations pattern may be set by means of a parameter other than those mentioned above; for example, the hourly rate of change in the number of rotations. Various settings may be used for setting the number-of-rotations pattern.

The setting of picking conditions has been described with reference to a picking operation at the time of deceleration of the loom. However, the same also applies to the case where the loom is accelerated. Picking conditions are set so as to correspond to the selected weft, as well as to an actual pattern of a change in the number of rotations during the pickable phase.

FOURTH EXAMPLE

Figure 7:
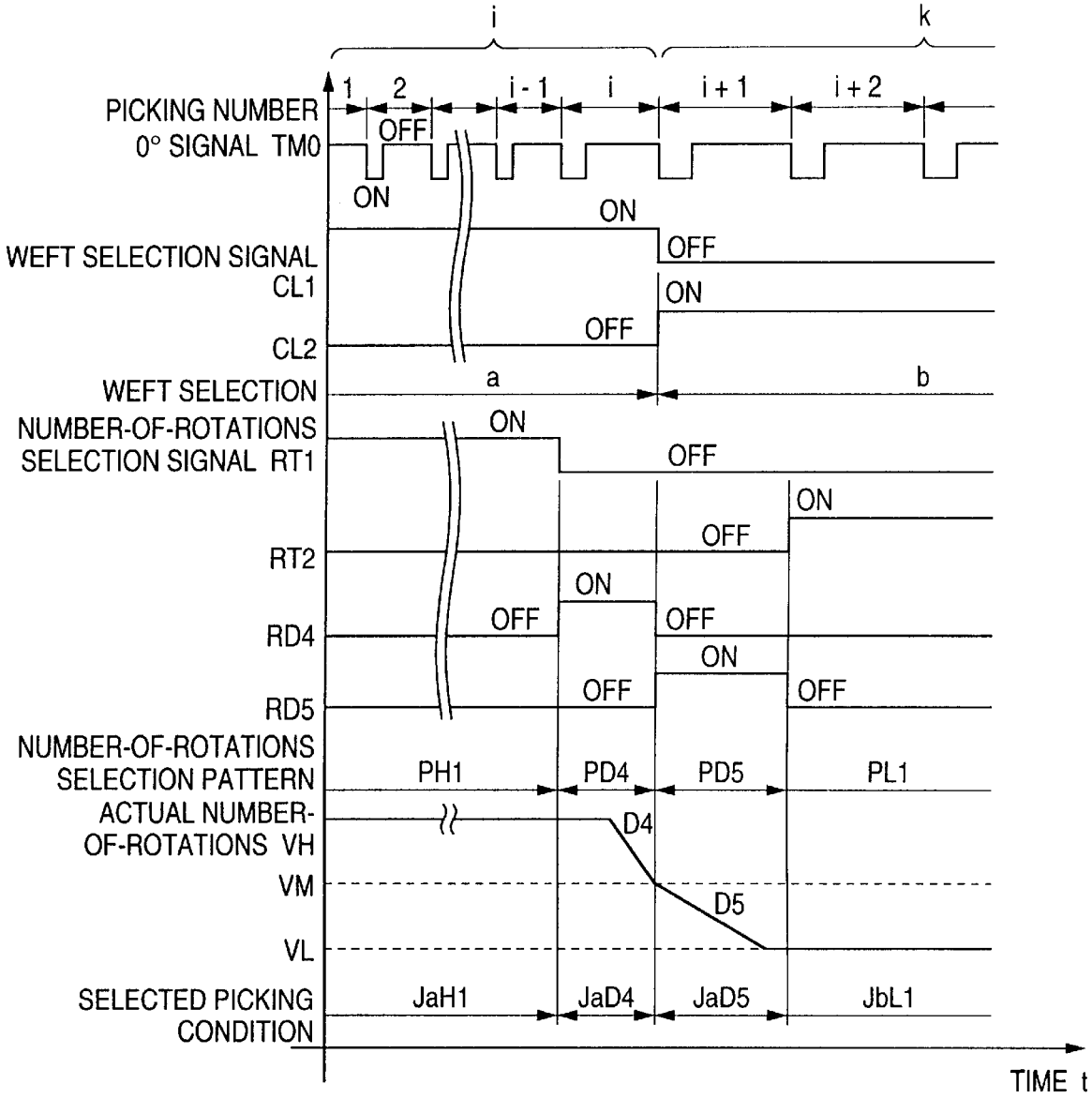
FIG. 7 is a timing chart showing the operation of a picking apparatus according to a fourth example of the present invention.

In the examples shown in FIGS. 3 through 6, the change of the number of rotations in response to changeover between the wefts is conducted while the weft that travels easily is picked. In a fourth example, the number of rotations pattern is set so that the change of the number of rotations is conducted not only when the weft that travels easily is selected, but also when the weft that travels with difficulty is picked. Specifically, as shown in FIG. 7, when the easy-to-travel weft "a" is switched to the difficult-to-travel weft "b" after the easy-to-travel wefts "a" have been picked by picking numbers "i", the loom is decelerated from the large number of rotations VH to the small number of rotations VL during a period of two picks at the time of changeover of the wefts, namely, during a period from picking number "i" to picking number i+1. Accordingly, the loom is decelerated while the weft "a" can be picked at picking number "i" and the weft "b" can be picked at picking number "i+1." In this case, in the selection signal generator 38, selection instructions for outputting the weft selection signal CL1 and the number-of-rotations selection signal RD4, both corresponding to the weft "a," are set for picking number "i"; and selection instructions for outputting the weft selection signal CL2 and the number-of-rotations selection signal RD5, both corresponding to the weft "b," are set for picking number "i+1" . The selection signal setting device 38 outputs number-of-rotations signals RD4 and RD5, and these signals are also delivered to the number-of-rotations instruction device 42 and the main control unit 62.

In the number-of-rotations instruction device 41, there are set the number-of-rotations pattern PD4 for decelerating the loom from the large number of rotations VH to a small number of rotations VM' at picking number "i" over a single picking period and the number-of-rotations pattern PD5 for decelerating the loom from the small number of rotations VM' to the small number of rotations VL at picking number "i+1" over a single picking period.

In the picking condition setting device 64, there are set picking conditions corresponding to the selected weft and to the change pattern in the number of rotations in a pickable phase during the course of changing the number of rotations. More specifically, for picking number "i", picking conditions JaD4 corresponding to the selected weft "a" and to the number-of-rotations pattern PD4 to be selected, that is, to the pattern D4 of a change in the number of rotations during the pickable phase are set in the picking condition setting device 64. Further, for picking number "i+1", picking conditions JaD5 corresponding to the selected weft "b" and to the number-of-rotations pattern PD5 to be selected, that is, to the pattern D5 of a change in the number of rotations during the pickable phase are set in the picking condition setting device 64. These picking conditions JaD4 and JaD5 are delivered to the main control unit 62. Accordingly, at picking number "i", the main control unit 62 selects the picking conditions JaD4 corresponding to the weft "a" and the pattern D4 of a change in the number of rotations, according to the weft selection signal CL1 and the number-of-rotations selection signal RD4, both of which are received from the selection instruction generator 38. As a result, the weft "a" can be picked under the picking conditions JaD4. Further, at picking number "i+1", the main control unit 62 selects picking conditions JbD5 corresponding to the weft "b" and the pattern D5 of a change in the number of rotations according to the weft selection signal CL2 and the number-of-rotations selection signal RD5, both of which are received from the selection instruction generator 38. As a result, the weft "b" can be picked under the picking conditions JbD5. As mentioned above, the loom is decelerated at each picking number according to the selected number-of-rotations pattern, and picking conditions corresponding to the selected weft and to the change pattern in the number of rotations are selected. As a result, the selected weft can be picked.

The number-of-rotations pattern set for a selected period; i.e., a single picking period, may be set such that the number of rotations of the loom constantly changes at a given rate or such that the number of rotations changes stepwise at different rates. Various settings of the number-of-rotations pattern other than the settings mentioned previously are conceivable. Picking conditions are also set so as to correspond to the selected weft and to the change pattern in the number of rotations during various pickable phases. Further, the pickable phase during which the number of rotations is changed in response to changeover between the wefts; i.e., the picking numbers, is not limited to two picks. Needless to say, the number of picks may be set to a number greater than two.

Setting of the picking conditions has been described with reference to the case where the loom is decelerated. However, the same also applies to the setting of the picking conditions when the loom is accelerated. As a matter of course, picking conditions are set so as to correspond to the weft to be picked, as well as to the change pattern in the actual number of rotations during the pickable phase.

FIFTH EXAMPLE

Figure 8:
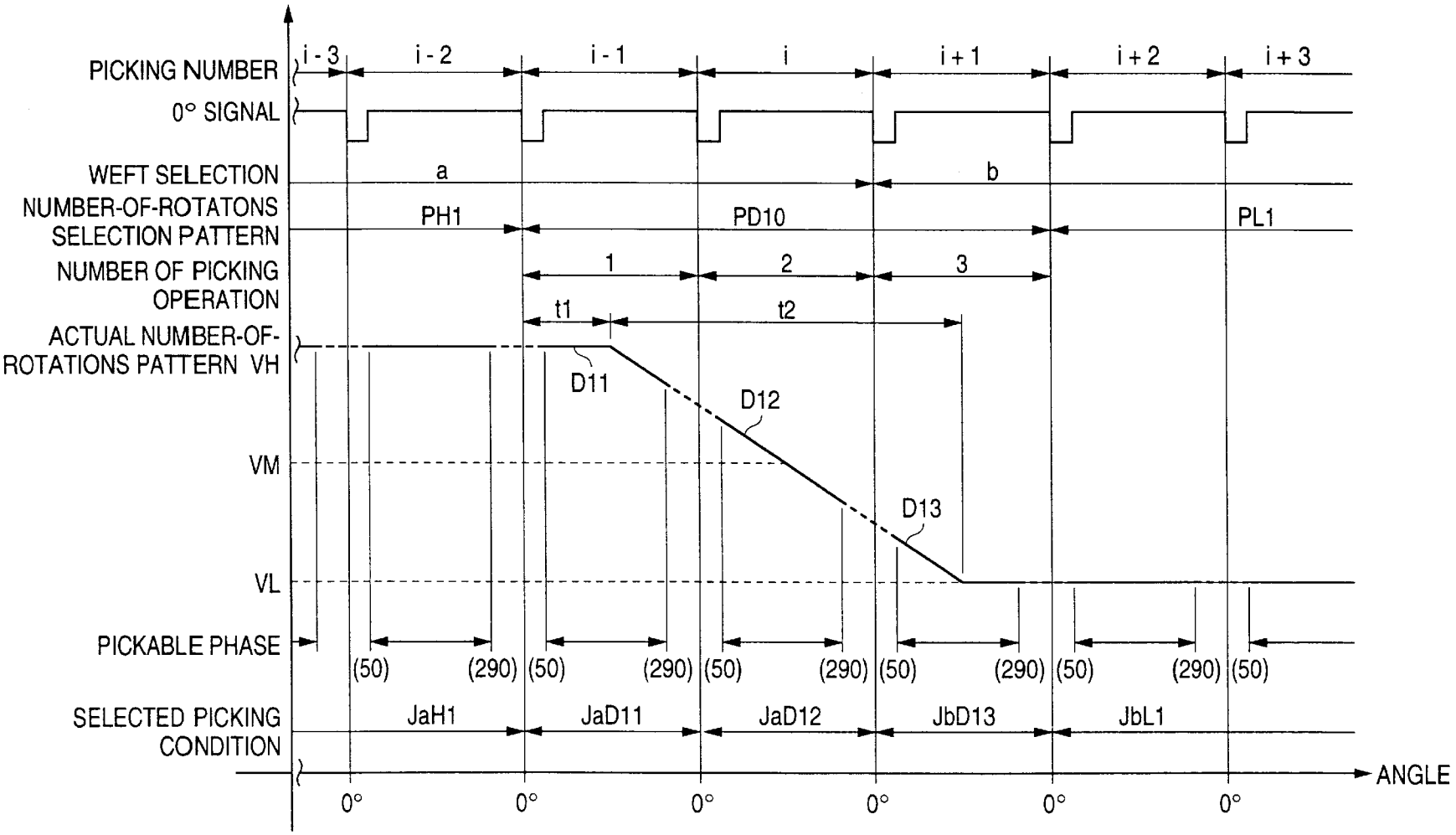
FIG. 8 is a timing chart showing the change pattern in the number of rotations during a pickable phase in the picking apparatus according to a fifth example of the present invention.

In the fourth example, the number-of-rotations pattern is set every picking in order to change the number of rotations. However, the number-of-rotations pattern may be set in units including several picks. In contrast with the first example in which the loom is decelerated from the large number of rotations VH to the small number of rotations VL, FIG. 8 shows another example of selection of a number-of-rotations pattern for decelerating the loom from the large number of rotations VH to the small number of rotations VL over three picking periods. More specifically, when the easy-to-travel weft "a" is switched to the difficult-to-travel weft "b" after the easy-to-travel wefts "a" have been picked by number of the picking operation "i", the loom is decelerated from the large number of rotations VH to the small number of rotations VL during three picking periods ranging from i−1 to i+1. For two picking periods; i.e., picking number "i−1" and "i," the weft "a" is selected and picked. For picking the last of the three picking periods; i.e., picking number "i+1," the weft "b" is selected and picked.

In the selection instruction setting device 37, selection instructions for outputting the weft selection signals and selection instructions for outputting number-of-rotations selection signals RD10, RT1, and RT2 are set in advance in the form of a pattern every pick so as to correspond to the picking number. The selection signal setting device 37 outputs the number-of-rotations selection signal RD10 to the selection signal generator 38 shown in FIG. 2 over three picking periods from picking number "i−1" to "i+1". The number-of-rotations selection signal RD10 is output to the number-of-rotations instruction device 42 and the main control unit 62.

In the number-of-rotations setting device 41, there is set a number-of-rotations pattern PD10 for decelerating the loom over three picking periods from the large number of rotations VH to the small number of rotations VL. The number-of-rotations pattern PD10 is delivered to the number-of-rotations instruction device 42. The number-of-rotations instruction device 42 stores the number-of-rotations pattern PD10 so as to associate with the number-of-rotations selection signal RD10. Upon receipt of the number-of-rotations selection signal RD10, the number-of-rotations instruction device 42 selects the number-of-rotations pattern PD10, to thereby change the number of rotations linearly over the picking periods from "i−1" to "i+1" of FIG. 6. Here, the loom is decelerated over the three picking periods by selection of the number-of-rotations pattern PD10. The change pattern in the number of rotations during the pickable phase represents the form of the respective lines designated by D11 to D13 of FIG. 8 for each picking.

In the picking condition setting device 64, there are set picking conditions corresponding to the selected weft and to the change pattern in the number of rotations during the pickable phase; i.e., the patterns D11 to D13. Specifically, picking conditions are set so as to correspond to the weft selection instruction, to the number-of-rotations selection instruction, and to the number of times that picking operations are performed (i.e., picking numbers) after receipt of the number-of-rotations selection instruction. In more detail, at picking number "i−1", the weft "a" is selected, and the selection instruction for selecting the number-of-rotations pattern PD10 is received. Further, a first picking of the weft "a" is performed after selection of the number-of-rotations pattern PD10. During this pickable phase, the change pattern in the number of rotations represents the form of a line designated D11 of FIG. 8. Accordingly, there are set picking conditions JaD11 corresponding to the weft "a" and to the pattern D11 of a change in the number of rotations. Further, at picking number "i," the weft "a" is selected, and a second picking of the weft "a" is performed after selection of the number-of-rotations pattern PD10. During this pickable phase, the change pattern in the number of rotations represents the form of a line designated D12 of FIG. 8. Accordingly, there are set picking conditions JaD12 corresponding to the weft "a" and to the pattern D12 of a change in the number of rotations. Further, at picking number "i+1", the weft "b" is selected, and third picking of the weft "b" is performed after selection of the number-of-rotations pattern PD10. During this pickable phase, the change pattern in the number of rotations represents the form of a line designated D13 of FIG. 8. Accordingly, there are set picking conditions JaD12 corresponding to the weft "b" and to the pattern D13 of a change in the number of rotations. The thus-set picking conditions JaD11, JaD12, and JaD13 are delivered to the main control unit 62.

In addition to the weft selection signal and the number-of-rotations selection signal, the main control unit 62 receives, for each pick, a 0° signal which is output from an unillustrated signal generator every time the spindle crank angle of 0° is passed. Upon receipt of the number-of-rotations instruction, the main control unit 62 counts the number of picking operations by counting the input of a 0° signal. The main control unit 62 then selects picking conditions corresponding to the selected weft, to the number-of-rotations instruction, and the number of times that the weft is picked after receipt of the number-of-rotations instruction. As a result, the selected weft can be picked. For instance, at picking number "i−1", the number-of-rotations signal RD10 is input to the main control unit 62, and the number of picking operations is reset to 1. The main control unit 62 selects the picking conditions JaD11 corresponding to the weft "a" and the pattern D11 of a change in the number of rotations according to the weft selection signal CL1 and the number-of-rotations selection signal RD10, both of which are received in the main control unit 62, as well as according to the number of picking operations; i.e., 1. The weft "a" is picked under the picking conditions JaD11. Subsequently, picking number "i" is counted, and the 0° signal is input to the main control unit 62, whereby the number of picking operations is incremented to 2.

Then, the main control unit 62 selects picking conditions JaD12 corresponding to the weft "a" and the pattern D12 of a change in the number of rotations according to the weft selection signal CL1 and the number-of-rotations selection signal RD10, both of which are received in the main control unit 62, as well as according to the number of picking operations; i.e., 2. The weft "a" is picked under the picking conditions JaD12. Next, picking number "i+1" is counted, and the 0° signal is again input to the main control unit 62, whereby the number of picking operations is incremented to 3. The main control unit 62 selects picking conditions JaD13 corresponding to the weft "b" and the pattern D13 of a change in the number of rotations according to the weft selection signal CL2, which corresponds to the weft "b," and the number-of-rotations selection signal RD10, both of which are received in the main control unit 62, as well as according to the number of picking operations; i.e., 3. The weft "b" can be picked under the picking conditions JbD13.

As mentioned above, by means of a deceleration pattern for decelerating the loom over several picking periods, the loom is decelerated over several picking periods. There are set picking conditions corresponding to the change pattern in the number of rotations in the pickable phase during deceleration of the loom. There are selected picking conditions corresponding to the change pattern in the number of rotations in the pickable phase according to the weft selection instruction, the number-of-rotations instruction, and the number of times that the weft is picked after input of the number-of-rotations instruction. As a result, the selected weft can be picked.

Setting of the picking conditions has been described with reference to the case where the loom is decelerated. However, the same also applies to the setting of the picking conditions when the loom is accelerated. As a matter of course, picking conditions are set so as to correspond to the weft to be picked, as well as to the change pattern in the actual number of rotations during the pickable phase.

Although the present invention has been described by reference to the air-jet loom, it goes without saying that the present invention can also be applied to a water-jet loom or other type of fluid-injection-type loom.

According to the first aspect of the present invention, a weft can be picked during the course of changing the number of rotations of the loom under picking conditions which are previously set so as to correspond to the selected weft and to the change pattern in the actual number of rotations in a pickable phase during the course of changing the number of rotations. Specifically, even if the number of rotations of the loom is changed abruptly, optimum picking conditions can be set in consideration of the change pattern in the number of rotations during the pickable phase, without involvement of so-called follow-up control for setting conditions. Therefore, the selected weft can be reliably picked, to thereby prevent a picking failure which would otherwise be caused by the conventional technique and greatly improve the productivity of a woven cloth.

According to the second aspect of the present invention, if picking conditions obtained through past experience are used as the picking conditions to be set in the picking conditions setting device, picking conditions can be quickly determined in response to the change in the type of textile. More preferably, the picking control unit may receive a weft detection signal from a weft feeler which is disposed along the weft traveling path and detects the weft. From the thus-received weft detection signal, the weft control unit may determine a weft arrival time which corresponds to the selected picking conditions. Subsequent picking conditions to be selected may be corrected on the basis of a deviation from preset target values. As a result, picking conditions to be selected can be made closer to optimum values in conjunction with progress in the weaving operation.

The present disclosure relates to the subject matter contained in Japanese patent application No. Hei. 10-269905 filed on Sep. 24, 1998.

While only certain embodiments of the invention have been specifically described herein, it will apparent that numerous modification may be made thereto without departing from the spirit and scope of the invention.

What is claimed is:

1. A picking method of a multicolor picking loom which changes the number of rotations of the loom according to which weft is desired to be selected, the method comprising the steps of:

previously setting picking conditions corresponding to the weft and a change pattern in the number of rotations in a pickable phase, during the course of changing the number of rotations; and selecting the corresponding picking condition from the preset picking conditions during the course of changing the number of rotations, to thereby pick the selected weft.

2. The picking method as defined in claim 1, wherein the picking conditions comprise at least one of a timing at which picking nozzles squirt fluid, a fluid injection pressure, or a timing at which a measuring device releases a weft.

3. A picking apparatus for a multicolor picking loom comprising:

a selected signal generation unit which counts a picking number every rotation of the loom and outputs a weft selection signal and a number-of-rotations selection signal, both corresponding to the picking number;

a drive unit which selects one from a plurality of preset patterns relating to the number of rotations of the loom which corresponds to the number-of-rotations selection signal and which drives the loom according to the selected pattern; and a picking control unit picking a weft corresponding to the weft selection signal, the picking control unit including:

a picking condition setting device setting picking conditions which correspond to the selected weft and a change pattern in the number of rotations of the loom during the course of changing of the number of rotations, said picking conditions being stored so as to correspond to the weft selection signal and the number-of-rotations selection signal, and a main control unit selecting the corresponding picking condition from the picking condition setting device according to the number-of-rotations selection signal and the weft selection signal, both of which are received from the selection signal generating unit, whereby the selected weft is picked under the selected picking conditions.

4. The picking apparatus as defined in claim 3, wherein the picking conditions comprise at least one of a timing at which picking nozzles squirt fluid, a fluid injection pressure, or a timing at which a measuring device releases a weft.

5. The picking apparatus as defined in claim 3, wherein the picking control unit receives a weft detection signal from a weft feeler which is disposed along the weft traveling path and detects the weft; from the received weft detection signal, the picking control unit determines a weft arrival time which corresponds to the selected picking conditions; and the picking conditions to be subsequently selected are corrected on the basis of a deviation from preset target values for the picking conditions.

6. A picking method of a multicolor picking loom in which first and second wefts are picked while changing the number of rotations of the loom according to which weft is desired to be selected, the method comprising;

a preparing step preparing a weft selection signal and a number-of-rotations selection signal which correspond to a picking number in a selection signal generation unit;

a setting step previously setting picking conditions corresponding to the weft to be selected and a change pattern in the number of rotations of the loom at a pickable phase in a picking condition setting device, said picking conditions being set to associate with the weft selection signal and the number-of-rotations selection signal;

a counting step counting the picking number of the first and second wefts;

a first outputting step outputting the weft selection signal and the number-of-rotations selection signal corresponding to the picking number to the picking condition setting device; and a selecting step selecting the corresponding picking condition from the picking conditions preset in the picking condition setting device, whereby the first and second wefts are picked based on the selected picking condition.

7. The picking method as defined in claim 6, further comprising:

a second outputting step outputting the number-of-rotations selection signal to a driving unit; and a driving step wherein the driving unit drives the loom based on the number-of-rotations selection signal.

8. The picking method as defined in claim 6, wherein the change of the number of rotations at the time that the picking is changed from the first weft to the second weft is conducted during the picking of at least one of the first and second wefts.

* * * * *